United States Patent [19]

McDaniel et al.

[11] 4,211,411

[45] Jul. 8, 1980

[54] APPARATUS FOR ELECTROMAGNETICALLY GENERATING FIELDS FOR REPELLING OR ATTRACTING PERMANENT MAGNETIC FIELDS FOR THE PURPOSE OF ENTERTAINMENT

[76] Inventors: Charles E. McDaniel; Yvonne McDaniel, both of 4300 Alexander St., Bakersfield, Calif. 93307

[21] Appl. No.: 798,586

[22] Filed: May 19, 1977

[51] Int. Cl.[2] ..... A63B 67/00

[52] U.S. Cl. ..... 273/345; 273/1 M; 273/239

[58] Field of Search ..... 273/95 R, 1 M, 85 F, 273/130 A, 131 A, 131 AD, 134 A, 134 AE, 135 A, 135 AD, 136 B, 137 A, 137 AE; 324/259; 46/45, 226, 227, 232, 234, 235, 236, 238, 239, 240

[56] References Cited

U.S. PATENT DOCUMENTS

| | | | |
|---|---|---|---|
| 2,472,916 | 6/1949 | Moon | 273/131 AD |
| 3,543,146 | 11/1970 | Sherwood | 273/1 M UX |
| 3,625,514 | 2/1971 | Haaland | 273/95 R |

*Primary Examiner*—William H. Grieb
*Attorney, Agent, or Firm*—Lyon & Lyon

[57] ABSTRACT

A device and method using an electromagnetic generator for generating magnetic fields to repel or attract permanent magnets which are placed in a specially configured mold comprised of a slotted non magnetic material attached to a base plate of non magnetic material. The permanent magnets are flat round disc shaped and are marked to identify polarity. The electromagnetic generator is placed beneath the mold and is energized through a momentary contact switch and a reversing selector switch for selecting the desired polarity. The electromagnetic generator is typically a coil powered by a suitable source of electric energy, typically rectified A.C. or D.C.. The reversing selector switch is employed to establish a fixed polarity while energized. A negative polarity of the electromagnetic generator will repel the negative polarity of a permanent magnet above it, ejecting it from its slot in the mold, causing it to move to another slot in the mold when properly directed by the position of the electromagnetic generator. A positive polarity will react to a positive polarity in the same manner.

9 Claims, 2 Drawing Figures

CASE No. 77/101

APPARATUS FOR ELECTROMAGNETICALLY GENERATING FIELDS FOR REPELLING OR ATTRACTING PERMANENT MAGNETIC FIELDS FOR THE PURPOSE OF ENTERTAINMENT

BACKGROUND OF THE INVENTION

It is well known in the art that either a permanent magnet or an electromagnet creates a magnetic field and that nearby magnetically charged particles tend to be attracted to that field when a negative and positive field are nearest each other, and they tend to be repelled from that field when a positive and a positive field or a negative and a negative field are nearest each other. Therefore it is possible to advance a permanent disc shaped magnet from slot to slot by proper placement and polarization of the electromagnetic generator beneath the slotted mold.

SUMMARY OF THE INVENTION

The present invention relates generally to a device and method for providing entertainment through the use of electromagnetics coupled with permanent magnets.

The present invention provides a novel method of generating electromagnetic fields of desired polarity to repel or attract a magnet of fixed polarity.

The present invention employs an electromagnetic generator, a slotted mold of non magnetic material, and an assortment of flat disc shaped permanent magnets and other accessories.

The mold is supported by a clear plastic base plate with support legs and the electromagnetic generator is placed beneath the mold and may be moved as desired.

The magnets are color coded on opposite surfaces to indicate positive and negative polarity.

A variety of games may be employed at the users discretion. Several magnets may be colored with a different color on opposite surfaces to identify polarity. An equal number of magnets may be colored on opposite surfaces by two colors not corresponding with the previous two colors.

For clarity lets say that one set of magnets is colored red on one surface and white on the opposite surface and the other set of magnets is colored green on one surface and yellow on the opposite surface. Lets further say that red and green indicate positive polarity and that white and yellow indicate negative polarity.

The present invention employs a selector switch for reversing polarity of the electromagnetic generator. The selector switch is a two position switch and is marked in one position with red and green markers and in the opposite position with white and yellow markers. When a magnet is positioned in a slot with the red(positive) side up its negative side is down. The electromagnetic generator is electrically connected in such a manner that when the selector switch is in the red/green position the top side of the generator will become a negative polarity when energized. This condition will cause the generator to repel the magnet.

The base plate of the slotted mold may be of clear, see through material so the user may accurately position the generator prior to energizing it.

The present invention employs a momentary contact switch which is temporarilly activated to energize the generator to repel said magnet. When the center of the generator is placed slightly off center beneath the magnet, and the switch is energized the magnet will jump away from the center of the generator and when properly employed may capture another magnet or advance to another slot at the users discretion.

In an alternative embodiment an audible alarm is employed, coupled with an indicating light. The audible alarm emits an audible signal and the indicating light emits a visual light when the generator is energized. This condition alerts the user to the duration the generator is energized and further enhances the nature of the game.

Other alternatives of the present invention will be apparent from the following detailed description of the invention.

DETAILED DESCRIPTION OF THE INVENTION

Figure 1:
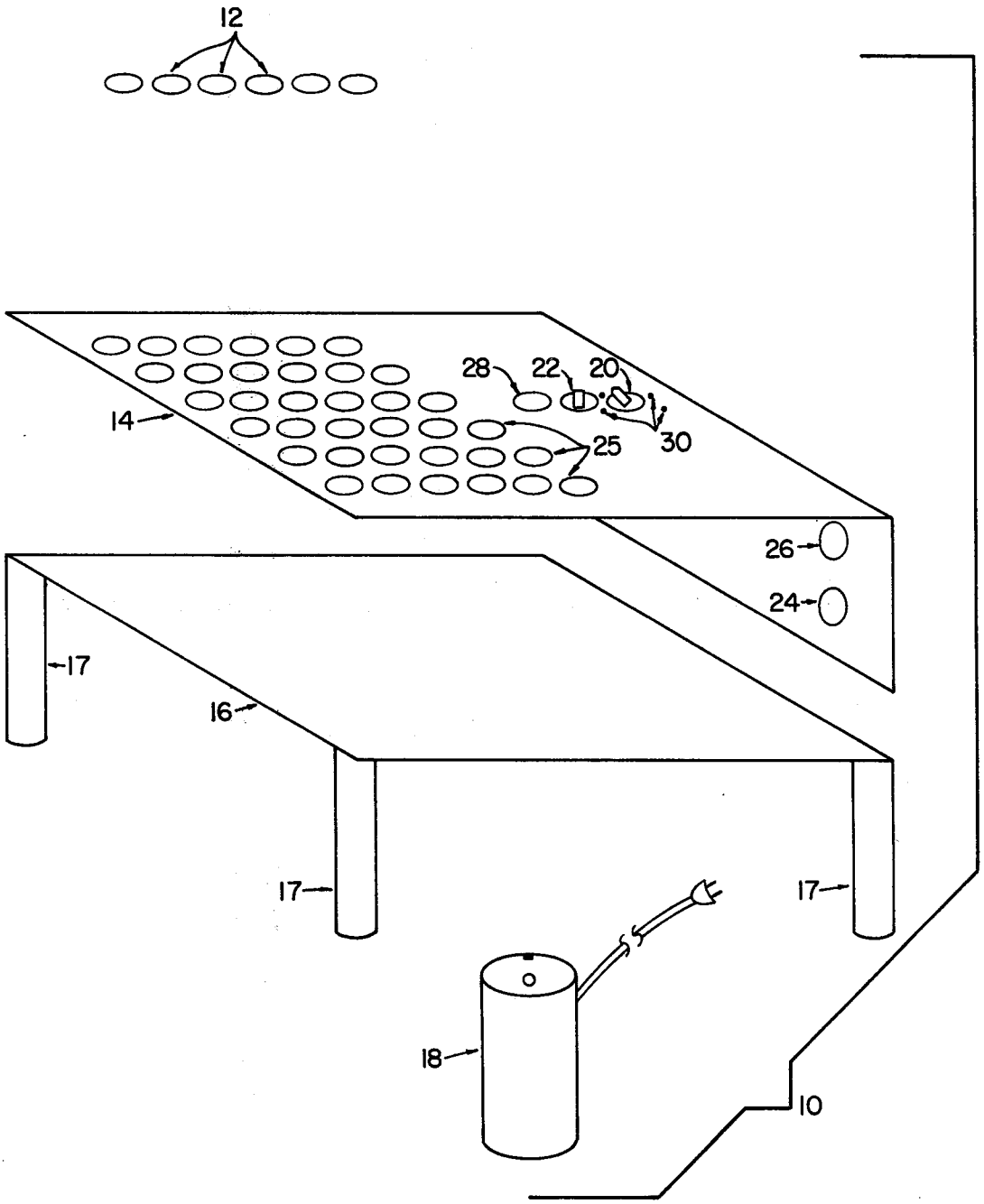
FIG. 1 illustrates in an exploded arrangement the components of a preferred embodiment of the device.

Referring now to FIG. 1, there is illustrated an exploded view of a preferred embodiment of the invention 10, which is comprised of an assortment of flat round disc shaped permanent magnets 12, a slotted specially configured mold 14, with slots or recesses 25, a clear rigid plastic base plate 16 with support legs 17, and an electromagnetic generator 18. The generator 18 is typically a coil powered by a suitable source of electrical energy, typically rectified A. C. or D. C., through a polarity selector switch 20 and a momentary contact switch 22, which energizes a receptacle 24, which receives a cord connection which energizes generator 18. The momentary contact switch 22 also energizes an audible alarm 26 and an indicating light 28.

Figure 2:
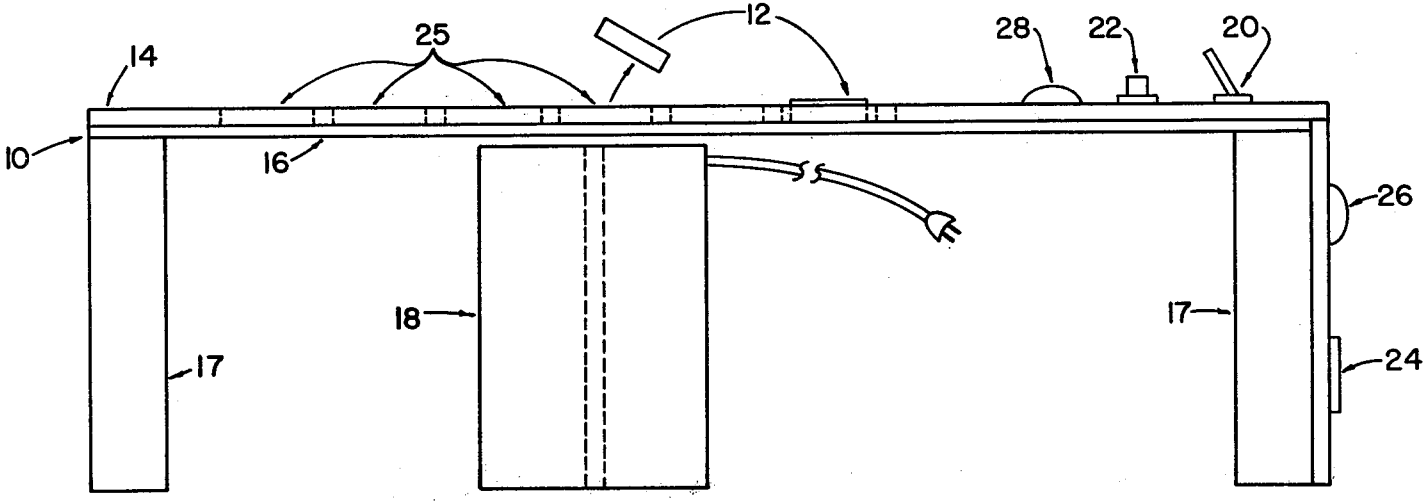
FIG. 2 illustrates the components of the preferred embodiment in their assembled relation.

Referring to FIG. 2, which illustrates the components of the preferred embodiment shown in FIG. 1 in their operative relationship, it can be seen that the mold 14 is affixed to the base plate 16 and the magnets 12 are positioned in the slots 25. FIG. 2 further illustrates the generator 18 is in position for play and has just been energized by activating switch 22 thereby ejecting magnet 12 from slot 25. It may be noted that generator 18 is off center from slot 25 thereby repelling magnet 12 in a direction away from generator 18. It is further noted that base plate 16 is of clear see through material. It is further noted that slots 25 are larger in diameter than are magnets 12 giving the user a margin of vision around magnets 12 and through base plate 16 enabling user to properly position generator 18 to eject magnet 12 in any desired direction. It is further noted that magnets 12 are color coded in order to determine polarity of said magnets 12. It is further noted that polarity selector switch 20 is marked at 30 in order to identify the polarity of generator 18 prior to activating switch 22 which energizes generator 18. Magnets 12 are colored on opposite surfaces with different colors to identify polarity, positive and negative. Any desired colors may be used but for clarity lets say that red and green identify positive polarity and that white and yellow identify negative polarity. A selection of magnets 12 are colored on their positive surface with red and their negative surfaces are colored white. A separate selection of magnets 12 are colored on their positive surfaces with green and their negative surfaces are colored yellow.

It is well known in the art that like polarities repel and unlike polarities attract. Therefore, if magnet 12 is positioned in slot 25 with the red, (positive) surface up and the white (negative) surface of said magnet 12 is down and to repel said magnet 12 from said slot 25 a negative polarity on top surface of generator 18 is required. Selector switch 20 may be marked at 30 to indicate polarity of generator 18. Generator 18 is then energized by activating switch 22. Magnets 12, colored green (positive) and yellow (negative) may be controlled in the same manner.

It will be noted that magnet 12 may flip over when ejected from slot 25 and will be influenced by surrounding magnets 12 and when opposite polarities come together magnets 12 will attach to each other and a capture is achieved.

In an alternative embodiment an audible alarm 26 is employed coupled with an indicating light 28. The audible alarm 26 emits an audible signal and the indicating light 28 emits a visible light when the generator 18 is energized and further enhances the nature of the game.

In another alternative the magnet 12 would have like polarity on top and bottom surfaces, (not shown). Two magnets laminated together with negative surfaces in contact will result in a magnet with positive polarity on the top surface and positive polarity on the bottom surface, and could only be attracted to a negative polarity. A reverse condition exists when two magnets are laminated with positive polarities in contact. With these conditions a user cannot capture one of his own magnets as like polarities repel.

The nature of the game is to capture the opponents magnets 12. When a capture is made the captured magnet 12 is removed from the slotted mold 14. When all the opponents magnets 12 are removed from the slotted mold 14 the game is won.

From the above, it can be seen that a new and useful apparatus for electromagnetically generating fields to control the movement of permanent magnets for entertainment and enjoyable games has been described.

Having thus described in detail a preferred embodiment of the invention, it is to be recognized that various substitutions may be made without departing from the spirit of the present invention and that these alterations are to be included within the invention.

What is claimed is:

1. An apparatus suitable for playing a game comprising:

(a) movable permanent magnets;

(b) a mold on which the permanent magnets are placed, the mold being of a non-magnetic material, the mold including recesses into which the magnets can be positioned; and (c) a movable electromagnetic generator for dispersing a magnetic field, the generator being provided with means for momentarily energizing the generator and means for reversing the polarity of the generator, wherein the electromagnetic generator is capable of being moved to a position relative to a selected one of said permanent magnets that when the electromagnetic generator is momentarily energized it repels the selected permanent magnet so that the selected permanent magent can become attached to an adjacent permanent magnet.

2. The apparatus of claim 1 wherein said electromagnetic generator is an electrically conducting coil.

3. The apparatus of claim 1 further including an audible alarm means for emitting an audible alarm when said electromagnetic generator is energized.

4. The apparatus of claim 1 further including an indicating light means for emitting a visible light when said electromagnetic generator is energized.

5. The apparatus of claim 1 wherein at least one of the permanent magnets has the same polarity on its top and bottom surfaces.

6. The apparatus of claim 5 wherein at least one of the permanent magnets has its polarity identified.

7. The apparatus of claim 1 in which the mold is supported at above ground level so that the electromagnetic generator can be moved into a selected position below the mold.

8. The apparatus of claim 1 wherein at least one of the permanent magnets has its polarity identified.

9. A game comprising:

(a) disc-shaped, movable permanent magnets having their polarity identified on their top and bottom surfaces;

(b) a mold supporting the permanent magnets, the mold having a plurality of recesses into which the magnets can be positioned;

(c) support means for maintaining the mold above ground level; and (d) an electromagnetic generator for dispersing a magnet field, the electomagnetic generator being provided with a momentary contact switch for momentarily energizing the generator and a reverse polarity switch for reversing the polarity of the generator, wherein the electromagnetic generator is capable of being moved under the mold to a position relative to a selected one of said permanent magnets that when the electromagnetic generator is momentarily energized it repels the selected permanent magnet so that the selected permanent magnet can become attached to an adjacent permanent magnet.

* * * * *